United States Patent [19]

Grunewald et al.

[11] 4,287,730

[45] Sep. 8, 1981

[54] BEARING SUPPORT FOR A WASHING MACHINE DRUM

[75] Inventors: Heinz L. Grunewald, Bremen; Jurgen Wellbrock, Lilienthal, both of Fed. Rep. of Germany

[73] Assignee: Engelhardt & Förster, Bremen, Fed. Rep. of Germany

[21] Appl. No.: 3,396

[22] Filed: Jan. 12, 1979

[30] Foreign Application Priority Data

Jan. 13, 1978 [DE] Fed. Rep. of Germany ..... 2801381

[51] Int. Cl.[3] ..... D06F 21/04; D06F 37/22

[52] U.S. Cl. ..... 68/140

[58] Field of Search ..... 68/139, 140, 142–145; 34/108, 129, 135–137; 134/156, 159, 160; 366/233; 248/550; 69/30; 432/103

[56] References Cited

U.S. PATENT DOCUMENTS 3,401,924 9/1968 Hurst ..... 366/233
3,869,883 3/1975 Rotter ..... 68/140 X
3,995,458 12/1976 Grunewald et al. ..... 68/140

FOREIGN PATENT DOCUMENTS 811248 4/1959 United Kingdom ..... 34/108

*Primary Examiner*—Philip R. Coe
*Attorney, Agent, or Firm*—George C. Atwell

[57] ABSTRACT

A tumbler-style washing machine having a tubular elongated drum adapted to be rotatable about its horizontal axis is provided with bearing-support structure for suspending and driving the drum, including a plurality of pulley-driven endless chain loops which suspend the drum from overhead rocker beam members. The rocker beam members are adapted to rock a limited distance in a vertical plane, to compensate for variations encountered during operation of the machine, such as load change, chain stretch and drum level fluctuation, etc., and a plurality of piston-cylinder units serve as buffering means for the rocker beam members. The piston-cylinder units are preferably supplied with internal fluid pressure and may be variously interconnected with each other and with specific control means to achieve an automatic support-adjusting action during operation of the washing machine.

13 Claims, 2 Drawing Figures

BEARING SUPPORT FOR A WASHING MACHINE DRUM

BACKGROUND OF THE INVENTION

This invention relates generally to support structure in a tumbler-style washing machine. More specifically, the invention pertains to the type of washing machine having an elongated rotatable tubular drum adapted to rotate about a horizontal axis, and a bearing support system for the drum which includes a number of buffers distributed along its length.

When a washing drum is secured to fixed support structure or to a bearing system originally secured to such structure, the bearing forces of the individual buffers may vary, both during idle periods and due to motion during operation, owing to the distribution of the mass of the drum, inaccuracies in manufacture, varying loads and changing tolerances between components which result through prolonged use. Such varying forces will vary even when the mass distribution of the drum is substantially uniform, or at least periodically uniform and even when the bearing points are distributed substantially uniformly along the drum, allowing for the existing mass distribution. Such variations in bearing forces whether occurring regularly or irregularly during operation, are extremely undesirable.

For example, if a tubular, rotatable drum is suspended to rotate about its longitudinal axis by means of a number of bearings, and, if required, driving elements such as chains or the like, each chain being guided around the surface of the drum and over a pulley disposed about the drum, variations in the load on the chains may frequently result in breakdown. Such breakdown may be due to the fact that the drum, which is usually welded from relatively thin sheet metal, will flex and distort relatively easily. This may be particularly true where the drum is substantially long (12 meters or more) and/or has a relatively small diameter. In addition, in the manufacture and assembly of such a drum, the intended round or tubular configuration may not be achieved since individual drum segments may become radially displaced during assembly such that parts of the drum are disposed eccentrically to the drum axis.

As a result of such factors, the chains or other bearing elements, even though uniformly spaced along the drum, may be subjected to greatly varying loads and the loading conditions will vary continuously during operation.

Under unfavorable circumstances, it may also happen that only a few in a plurality of bearing chains will actually bear a load, at least for a time, with the other chains in the plurality being subjected to little or no load. This overstressing of a few of the bearing elements will quite often result in breakdown. In order to avoid such damage, the chains or other bearing elements must be made considerably oversized. This, however, will result in very heavy and expensive chains or other bearing elements and will also result in the undesirable need for operatively associated elements, such as drive pulleys, of unreasonably cumbersome size.

In order to avoid or largely reduce the aforementioned disadvantages and to absorb or attenuate the impacts or similar stresses resulting therefrom or caused by external factors (such as the motion of the articles being treated during the washing and conveying process) it has heretofore been proposed that the pulleys for guiding the chains or the like should each be held on a substantially horizontally extending rocker beam element which projects generally transverse to the longitudinal axis of the drum, and that one end of the rocker be made pivotal about a horizontal axis while the other end is resiliently borne by a buffer in the form of a rigidly mounted spring. Such a bearing system can reduce the effect of non-uniform stressing of the chains or the like caused by inaccuracies during manufacture, but it does not achieve uniform distribution of stress on the chains during operation. Another disadvantage of this system is that the springs have to be individually adjusted by hand and readjusted by hand after the inevitable stretching of the chains during operation. Even when such laborious adjustment has been performed, the uniform stress placed on the chains is immediately lost when the drum has rotated through a fraction of a complete revolution due to the inaccuracies heretofore described with regard to manufacture and assembly of the drum. More specifically, departures from roundness and the radial offset of the individual segments will destroy any uniformity of stress distribution as soon as the drum is partly rotated away from the position in which the adjustment was made. Moreover, the known system heretofore described cannot be utilized for adjusting the level of the drum, though the ability to make such adjustment is very desirable.

SUMMARY OF THE INVENTION

A primary object of the present invention is to provide a bearing system in which a washing drum is borne by a number of buffers distributed along the drum so that the bearing forces are equal at all the bearing points, that is, at the location of all the bearing elements, so that, for example, if a horizontally elongated tubular rotatable drum is suspended from chains or the like, all of the chains will be substantially uniformly loaded during operation in spite of variance of the configuration of the drum. It is also an object of this invention to achieve automatic, subsequent adjustment of load and stress on bearing elements in a washing machine after the bearing elements, such as chains and the like, have stretched in operation, and to provide a preferably automatic means for adjusting the level of the rotatable drum.

To achieve the foregoing objectives, the apparatus of the invention includes buffering means comprising a plurality of piston-cylinder units, the cylinders of which are supplied with a fluid pressure medium and wherein each cylinder is connected to at least one other cylinder in the plurality. As explained hereinafter, it is presently preferred that the pressure medium is a gas which, for economic reasons, is preferably air.

If a washing drum is provided with a bearing system of the aforementioned kind, and if, for example, all the cylinders in the piston-cylinder units forming the buffering means are interconnected, in accordance with one form of this invention, uniform pressure is obtained in the cylinders as a result of their interconnection after the cylinders have been supplied with pressure medium from a pressure medium source and after the drum has been thereby elevated and the piston-cylinder units have subsequently been disconnected from the pressure source. As a result, the bearing forces at each piston-rod are the same, as will be shown in detail with reference to another example.

If, after operation, the complete drum has to be raised to the operating level, an additional adjustment in level has to be made, then, in accordance with a form of this invention, it is preferable not to connect all the cylinders together but only to connect the cylinders into a number of groups, preferably with a group of neighboring or adjacent cylinders disposed at one end of the drum whereby the distance between each pair of adjacent piston-cylinder units remains approximately the same.

According to this invention, the pressure medium conduits or lines to the groups of cylinders can each be connected via a controllable shut-off means to a common pressure source or a pressure medium supply line leading to a pressure source. The controllable shut off means are preferably solenoid valves, each means being actuated by a level pick-up measuring the height, at the appropriate place, of the drum to be suspended, so that the shut-off means opens the pressure medium supply when and as long as the drum is below a given minimum height at the point of measurement. Preferably, level pick-ups are disposed at each end portion of the drum.

BRIEF DESCRIPTION OF THE DRAWING

Other features and advantages of the present invention will become apparent from the ensuing detailed description and by reference to the accompanying drawings wherein.

DETAILED DESCRIPTION OF THE PREFERRED EMBODIMENT

Figure 1:
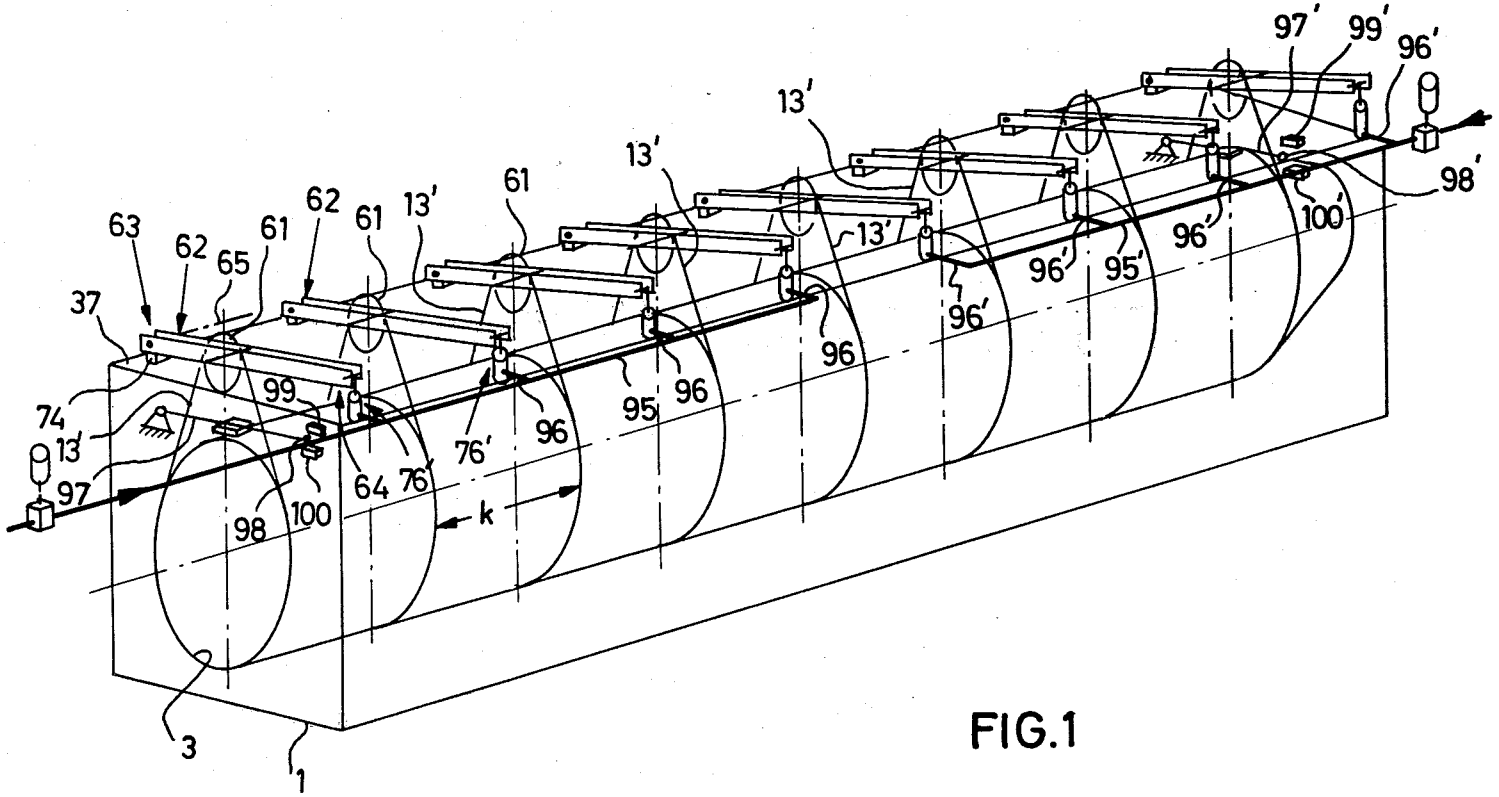
FIG. 1 is a diagrammatic perspective view of a tumbler-type washing machine drum supported for operation by the bearing system of the present invention.

FIG. 1 diagrammatically illustrates a continuous tumbler-type washing machine comprising a horizontally elongated tubular drum 3 disposed in a box-like housing 1. The drum 3 is supported from a frame structure 37 which, although not shown in detail in the drawing, may be considered as the top surface of housing 1.

The frame structure 37 has disposed thereon, in a spaced-apart orientation, eight rockers or rocker beam members 62. One end 63 of each rocker 62 is pivotally secured to a bearing 74, and each bearing 74 is rigidly secured to the frame structure 37. The rockers 62 are thereby adapted to be pivotally moved around a horizontal axis in a substantially vertical plane from their substantially horizontal normal position. Each rocker 62 has an end 64 which is mounted to the frame structure 37 by a buffer 76'. A guide pulley 61 is journaled to each rocker 62 and an endless chain 13' is supported on each guide pulley 61.

Each pulley 61 and its associated chain 13' is driven by a separate motor (not shown) so that chains 13' drive drum 3 as well as suspendedly support it. As shown in FIG. 1, each chain 13' is guided around the bottom outer surface of the drum 3 so that the drum is suspendedly held and driven by the eight chains 13'. A distance k between each pair of adjacent chains 13' is the same in each case and equal to the length of a section of drum 13, which is made up of seven such sections. It is necessary to distribute the bearing means along a component such as the washing drum 3 in the aforementioned manner in order to avoid the considerable sagging which would otherwise occur owing to the weight of the drum, particularly from the load carried therein during operation.

Drum 3 is mainly constructed of relatively thin sheet metal and, therefore, sags considerably and departs from its intended tubular roundness owing to the changes in shape resulting from welding and the like and some unavoidable relative radial displacement of the individual segments. Consequently, if it were not for the special arrangement and operation of buffers 76' (if, for example, each buffer 76' were replaced by rigid bearings or springs) the suspension chains 13' would be non-uniformly loaded such that perhaps only a few of the eight chains 13' would be loaded (the load thereon being correspondingly heavy) whereas the other chains 13' would bear little or no load. Such non-uniform loading of the chains may result in fractures unless the chains are made unacceptably oversized to guard against the most unfavorable case wherein the total load would have to be borne by only two or three chains, and even then the loading would not be uniform.

If, however, the means bearing the rocker 62 (the buffers 76' in FIG. 1) are adjusted so that the load on the chains is substantially uniform, it is found that the load is no longer uniform if the drum 3 rotates only through a fraction of its total circumference where, due to the aforementioned departures from roundness and the radial displacement and the like, the geometrical errors may be completely different in the new position. In addition, any adjustment made by hand will alter during operation, owing to the unavoidable stretching of chains 13'. Accordingly, when a washing drum, such as drum 3, is suspended in the aforementioned manner (and such suspension is extremely advantageous for a number of reasons) the chains 13' are non-uniformly loaded and may break, resulting in disturbance in operation or total breakdown of the equipment. However, these characteristics inherent in known bearing systems are avoided by the bearing system of this invention since the rockers 62 are borne by buffers 76' comprising piston-cylinder units.

Figure 2:
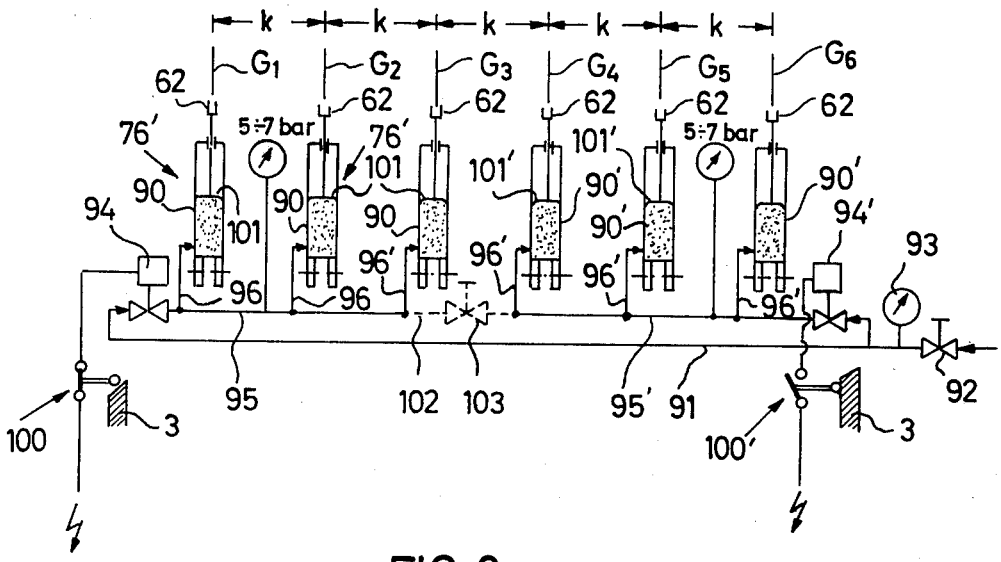
FIG. 2 is a more detailed diagrammatic representation of a bearing system in accordance with this invention.

The bearing system of the present invention may be understood by reference particularly to FIG. 2, which for simplicity shows only six buffers 76' corresponding to a drum made up of six sections. This difference in number of sections and associated components, as compared to FIG. 1, makes no difference in the principle of the invention, but somewhat simplifies the explanation thereof. It should be understood that the principles hereafter explained would be applicable to a drum made up of any reasonable number of sections, whether more or less than the drum 3 specifically illustrated.

As heretofore mentioned, buffers 76' are piston-cylinder units comprising cylinders 90 adapted to be supplied with compressed air. The air comes from a pressure medium source (not specifically shown in FIG. 2) connected to a pressure medium supply line or conduit 91 containing a shut-off means 92 and a pressure gauge 93. The air pressure is about 8–10 bars and can be adjusted by a pressure regulating valve on the shut-off means 92. Compressed air coming from conduit 91 travels through a solenoid valve 94 into a pressure medium pipe 95 and through a solenoid valve 94' into a pressure medium pipe 95'. After leaving pipes 95 or 95', the compressed air travels through branch pipes 96 and 96' to a first group of cylinders 90 or a second group of cylinders 90', the adjacent cylinders in the first group being interconnected in the same manner as the cylinders 90' in the second group. Cylinders 90, i.e. the first group of piston-cylinder units or buffers 76', are disposed along the left-half of drum 3, whereas cylinders 90' are disposed along the right-half of the drum. The piston-cylinder units are all identical so that not only the cylinders but also the associated pistons are of similar construction.

A lever 97, 97', respectively, is disposed at either end on drum 3, one end of each lever being secured to housing 1. Levers 97, 97' are secured to housing 1 so as to be vertically pivotable and have magnets 98,98' respectively at their free ends. Near the free end of each lever 97, 97' there is a pair of solenoid switches, first solenoid switch 99, 99' being disposed above the corresponding lever 97, 97' and a second solenoid switch 100, 100' being disposed below the corresponding lever when the lever is in the normal position.

The bearing system of the present invention is adapted to be placed in an inoperative or shut-down position, for example, at night, by lowering drum 3 below its normal operating position and resting it upon sliding elements (not shown) which are provided at edges of each section whereby each individual section is supported separately both during operation and shut down. When the washing machine is placed into operation again, the shut-off means 92 is opened and adjusted so that the air pressure in the supply line 91 builds up to 8–10 bars, which may be monitored at the pressure gauge 90.

Since the drum 3 is below the operating position, as indicated at the left of FIG. 2, the solenoid switch 100 is closed and thus electrically connected to the corresponding solenoid valve 94 which opens and omits compressed air from line 91 to the pressure medium pipe 95 and thence via branch pipes 96 to the first group of cylinders 90. Of course, when the machine is brought back into operation, the same applies to the second group of cylinders. In FIG. 2, the second group is shown in a different position, that is, the position when the right end of drum 3 is already at the planned operating level. In this position, (which, of course, is reached by the left group after a certain time) the solenoid switch 100' opens, thus disconnecting the associated solenoid valve 94' from the current supply and closing it, so that no more compressed air can flow from line 91 into pipe 95'. After this switching off or cut-off operation, the group of cylinders formed by the piston cylinder units 76' in the right-hand group form a closed system, with the connecting pipes 96' and 95, which can be influenced only from the exterior via pistons 101'.

After both ends of drum 3 have been raised to the operation level, pistons 101, 101' bear the total weight G of drum 3, its contents, parts of the rockers 62 and the pulleys 61 secured thereto, and the associated drives (not shown). The total weight G borne by buffers 76' is made up of the individual weights $G_1$–$G_6$ acting on the individual buffers 76', which may vary relatively considerably if buffers 76' are not the bearing system according to the invention but are instead, for example, rigid bearings or the like. The variations in bearing forces resulting in varying loads on chains 13 are due not only to the differences in mass distribution due to the loads or the like, but are closely dependent upon non-circularity of the drum 3 and on other inaccuracies during manufacture, due to radial displacement of the components, etc.

With continued reference to FIG. 2, if there are differences in the individual loads $G_1$, $G_2$, $G_3$ on the left group of buffers 76' (with respect to which the operation of the system according to the invention will be explained in detail) and if it is assumed that the weight force of $G_1$ is greater than the weight forces $G_2$ and $G_3$ the result is that the cylinder 90 loaded by the strongest force $G_1$ is at a higher pressure than the other two cylinders 90 in the left group of buffers. Since, however, cylinders 90 are interconnected by lines 96 and 95, the pressure is equalized between cylinders 90. If the two cylinders 90 were subjected only to the weight forces $G_2$ and $G_3$, their pistons 101 would move upwards until they struck the end wall of the cylinder, since the force on pistons 101 is equal to the piston surface multiplied by the pressure in cylinder 90 which varies with the force $G_1$ so that the resulting force is always greater than the counteracting forces $G_1$, $G_2$ and $G_3$.

In the present case, the force is not single, but the component to be borne, i.e. drum 3, extends through the entire bearing system. Consequently, owing to the pressure equilibrium resulting from the connection to the cylinders 90 acted upon by force $G_1$, the pistons 101 acted upon by forces $G_2$ and $G_3$ absorb greater forces $G_2'$ and $G_3'$ when they extend. Since, however, the total force G acting on all the pistons 101, 101' is constant, the initially more heavily loaded pistons are inevitably and automatically relieved from load and an equilibrium of forces is obtained such that the load is equal on all the pistons in a group, that is, on all the chains 13' as shown in FIG. 1. A corresponding process as heretofore described occurs in the other group of pistons.

If the bearing forces at all the bearing points, not only inside the single group of pistons, are to be equal, the two pressure medium lines 95 and 95' can be connected by line 102, advantageously containing a shut-off means 103 for bringing drum 3 up to a preset level as previously described when operation begins. Owing to this level of compensation, which is another desired objective of this invention, line 102 can usually be omitted inasmuch as no automatic level compensation could be obtained during operation.

If, as a result of inevitable losses of compressed air during operation, drum 3 sinks sufficiently to close solenoid switches 100 or 100' as shown on the left side of FIG. 2 the associated solenoid valve 94 and/or 94' opens so that additional compressed air can flow from the compressed air source.

It can be seen that by means of the bearing system of the present invention, the chains 13' (at least in one group of cylinders) are always uniformly loaded without any subsequent adjustments being necessary. This increases the reliability in operation and, more particularly, considerably increases the working life of the chains in the entire machine.

Owing to the automatic operation, no subsequent adjustment is required, thus correspondingly reducing the maintenance. As can be readily seen, the bearing system according to the invention is particularly suitable for bearing the drums of tumbler type washing machines. However, such drums do not need to be suspended only in the manner as shown with respect to the presently preferred embodiment.

A further advantage of the illustrated embodiment using the bearing system according to the invention is that after the machine has been switched off, the chains are even more gently treated owing to the resulting unloading, since the drum 3, after operation thereof has ceased, rests on bands or rings, each disposed between two adjacent segments of drum 3. Since the bands are pressed firmly against the outer drum when it is lowered, the individual segments are very efficiently supported even in the inoperative state.

It should also be noted with respect to the illustrated embodiment that an inherent characteristic of the arrangement shown is that the drum 3 cannot begin operation until it has reached the set operating level.

The structure described herein and shown in the accompanying drawing is presented only for the purpose of explaining the invention and it is not intended to limit the invention's scope. It is contemplated that the apparatus of the invention may be variously adapted, changed or modified without departing from the spirit and scope of the invention as defined in the appended claims.

We claim:

1. A bearing system in a tubular-type washing machine, comprising a substantially horizontal elongated drum, a plurality of buffers distributed in spaced-apart relation along the drum and connected to the drum and supporting it in suspension, each of such buffers including a piston-cylinder unit, means supplying a fluid pressure medium to the cylinders, each piston-cylinder unit having means therewith rendering it adjustable to load variation by the response of the piston to the pressure of the fluid pressure medium in the cylinder, and the cylinder of any one of the buffers being in flow interconnection with the cylinder of a second of the buffers.

2. A bearing system in a tubular-type washing machine, comprising a substantially horizontal elongated drum, a plurality of supporting buffers distributed in spaced-apart relation along the drum, each of said buffers including a piston-cylinder unit and being adapted to support a portion of the drum, means supplying a fluid pressure medium to the cylinders, each piston-cylinder unit having means therewith rendering it adjustable to load variation by the response of the piston to the pressure of the fluid pressure medium in the cylinder, and the cylinder of any one of the buffers being in flow interconnection with the cylinder of a second of the buffers, the piston-cylinder units being arranged in at least two groups, each group being arranged along a separate longitudinally-successive section of the drum, and the cylinders being in fluid-flow interconnection only with cylinders of the same group.

3. The system of claim 1 or 2 wherein the pressure medium is a gas.

4. The system of claim 1 or 2 wherein each cylinder is connected in fluid-flow communication with an adjacently-disposed one of the cylinders.

5. The system of claim 1 or 2 wherein approximately the same distance is maintained between any two adjacent piston-cylinder units.

6. The system of claim 2 wherein the cylinders of each group of buffers are interconnected, and a separate pressure medium line is connected to the cylinders in each group.

7. The system of claim 2 wherein the pressure medium lines are each connected through a controllable shut-off means to a common fluid pressure source.

8. The system of claim 7 wherein the controllable shut-off means are solenoid valves.

9. The system of claim 7, further including a level pick-up for each controllable shut-off means, each controllable shut-off means being controlled by one of the level pick-ups which measures the level of the drum at a predetermined point along the drum so that each shut-off means is opened when and as long as a corresponding part of the drum is below a predetermined maximum height.

10. The system of claim 9 wherein one of the level pick-ups is disposed at each end portion of the drum.

11. The system of claim 1 or 2 wherein all the piston-cylinder units are substantially identical in construction.

12. The system of claims 1 or 2 wherein each buffer further includes a rigid rocker beam member extending over the drum and generally transverse to the drum axis, each beam member being pivotal at one end and having one of said piston-cylinder units located at its other end and adapted to cause the beam to pivot in a generally vertical plane by movement of the piston of said one piston-cylinder unit.

13. The system of claim 12 further comprising a pulley on each beam, and the pulley supporting an endless chain loop encircling the drum.

* * * * *